US005168882A

United States Patent [19]

Beguin et al.

[11] Patent Number: 5,168,882

[45] Date of Patent: Dec. 8, 1992

[54] DEVICE FOR CHECKING A STREAM OF TOBACCO BEFORE TRIMMING

[75] Inventors: Jean-Jacques Beguin, Dombresson; David Vuilleumier, Neuchâtel, both of Switzerland

[73] Assignee: Fabriques de Tabac Reunies, S.A., Neuchatel, Switzerland

[21] Appl. No.: 717,937

[22] Filed: Jun. 20, 1991

[30] Foreign Application Priority Data

Jun. 26, 1990 [CH] Switzerland ..... 2121/90

[51] Int. Cl.[5] ..... A24C 5/18

[52] U.S. Cl. ..... 131/84.4; 131/84.2

[58] Field of Search ..... 131/84.1–84.4; 30/345; 76/DIG. 6, 101

[56] References Cited

U.S. PATENT DOCUMENTS

| | | | |
|---|---|---|---|
| 3,030,966 | 4/1962 | Lanore | 131/84.2 X |
| 3,261,366 | 7/1966 | Richter et al. | 131/84.4 |
| 3,387,368 | 6/1968 | Scheck | 30/345 X |
| 3,415,206 | 12/1968 | Reisman | 30/345 X |
| 4,033,360 | 7/1977 | Nienow et al. | 131/84.1 |
| 4,771,794 | 9/1988 | Gaisser et al. | 131/84.1 |
| 5,003,996 | 4/1991 | Tallier et al. | 131/84.2 |
| 5,012,823 | 5/1991 | Keritsis et al. | 131/84.1 X |

FOREIGN PATENT DOCUMENTS

| | | | |
|---|---|---|---|
| 1336960 | 9/1963 | France . | |
| 2028098 | 3/1980 | United Kingdom | 131/84.4 |
| 2072483 | 10/1981 | United Kingdom . | |

*Primary Examiner*—V. Millin
*Assistant Examiner*—J. Doyle
*Attorney, Agent, or Firm*—Jeffrey H. Ingerman

[57] ABSTRACT

The device is made up of a cylindrical rotary disk (32), part of the cylindrical outside surface (**32*b***) of which intercepts a surplus portion of the stream of tobacco and separates it from the main stream. The surplus portion is eliminated and recycled without damaging the tobacco fibers. The device is intended to be disposed before trimming and compression apparatus which prepares a rod of tobacco in order to regulate the thickness of the rod before segments thereof are compressed. Thus, each compressed segment will have the same density of tobacco.

5 Claims, 2 Drawing Sheets

Figure 1:
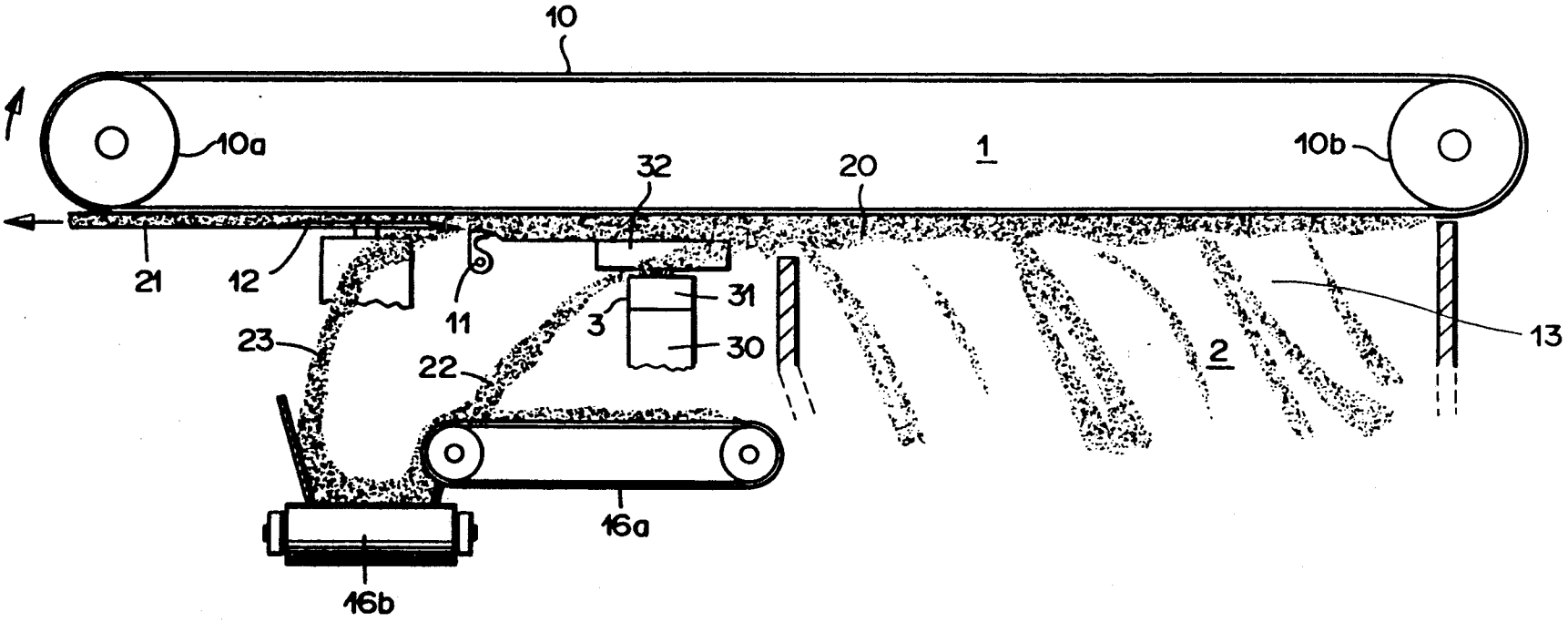

FIG. 2
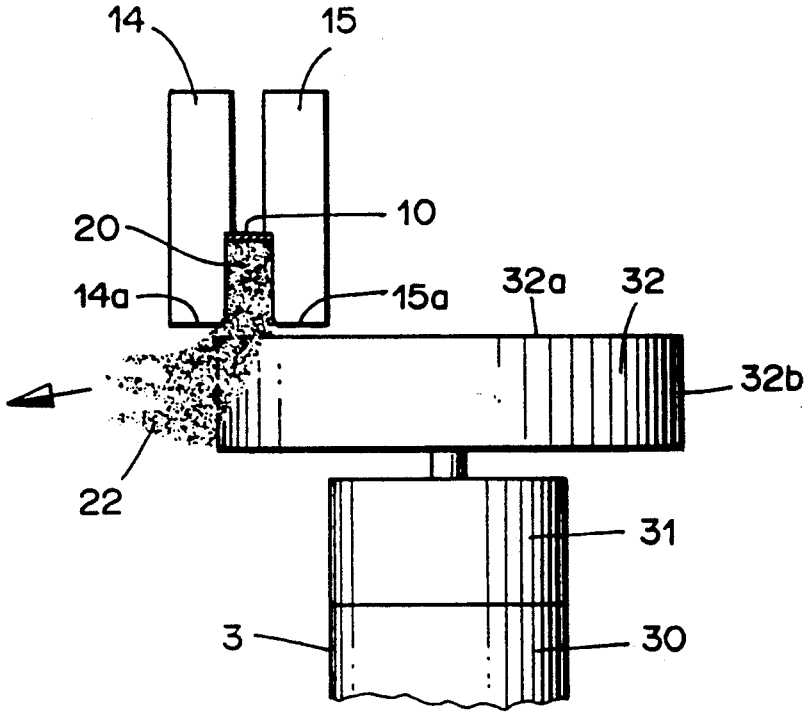
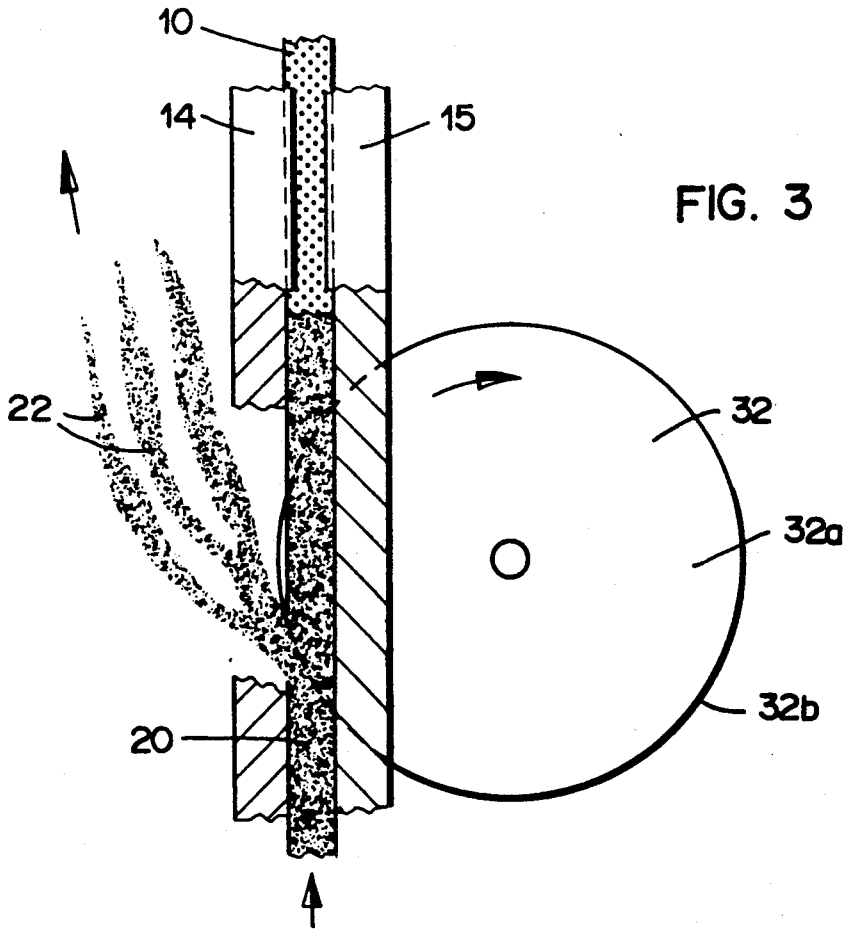
FIG. 3

DEVICE FOR CHECKING A STREAM OF TOBACCO BEFORE TRIMMING

This invention relates to equipment for manufacturing tobacco products, and more particularly to a device for checking a stream of tobacco.

During the manufacture of cigarettes, the tobacco is conveyed in a continuous stream toward trimming and compression apparatus, where a uniform rod of tobacco is formed prior to being wrapped in cigarette paper, then cut into individual cigarettes. During the passage of the stream of tobacco through the apparatus; it is first compressed at specific locations, then the quantity of tobacco exceeding what is necessary for making the cigarette rod is eliminated by a trimming device.

Such trimming and compression apparatus is described in commonly-assigned U.S. Pat. No. 5,003,996. In that apparatus, the tobacco is drawn by suction to agglomerate against a thin, porous band moving longitudinally; this band conveys the tobacco between two lateral rails and carries it first of all toward a cam which slightly compresses the tobacco, i.e., which increases its density over a short distance; the rod of tobacco passes immediately thereafter into a trimming device made up of two circular rotating cutters responsible for eliminating the surplus tobacco in order to obtain a uniform rod of tobacco comprising equally spaced segments where the density of tobacco is greater than in the rest of the rod. The individual cigarettes are then cut at these higher-density or reinforced segments, each of which then forms a sort of plug preventing the tobacco from running out of the cigarette.

The drawback of such apparatus is that the thickness of the stream of tobacco is quite uneven before the cam compresses a segment of it; hence the compressed segments obtained have densities of tobacco differing from one another since the compression cam can act upon stream thicknesses which are very different from one another. This thickness is obviously regulated subsequently by the trimming cutters, but irregularities in tobacco density remain nonetheless in the compressed segments.

In order to overcome this drawback and thereby increase the uniformity of the cigarettes produced, the stream of tobacco, i.e., its thickness, must be checked before it enters the trimming and compression apparatus.

On the other hand, the surplus tobacco to be eliminated from the cigarette rod must not be damaged, i.e., the tobacco fiber must not be torn or mangled. Thus simple devices such as a scraper knife or a fixed or rotary brush cannot be used because they damage the tobacco fiber.

It is therefore an object of this invention to provide an improved device for checking the thickness of the layer of tobacco which is to form the cigarette rod, whereby the aforementioned drawbacks may be eliminated without damaging the tobacco.

To this end, the checking device according to the present invention is made up of a rotary cylindrical disk, the plane of rotation of which is perpendicular to the irregularities of the stream of tobacco, and the axis of rotation of which is perpendicular to the direction of flow of the stream of tobacco, this disk being disposed upstream from trimming and compression apparatus.

A preferred embodiment of the invention will now be described in detail with reference to the accompanying drawings, in which:

FIG. 1 is an elevation of trimming and compression apparatus preceded by a device for checking the stream of tobacco, FIG. 2 is an elevation of the checking device in a preferred embodiment, and FIG. 3 is a top plan view, partially in section, of the checking device.

The trimming and compression apparatus 1 shown in FIG. 1 corresponds to that described in the patent application mentioned earlier; it is composed mainly of an endless band 10 driven with a translatory motion between two pulleys 10*a* and 10*b*, either of the pulleys being rotatingly driven by a motor (not shown), of a compression cam 11, and of two rotary cutters 12 trimming the surplus tobacco. Tobacco 2 comes from an intermediate supply 13, whence it is drawn up by a suction force passing through band 10 so that the tobacco fibers agglomerate against band 10 and form a layer 20 bounded in width by two side rails 14 and 15 (shown in FIGS. 2 and 3). It will be noted that layer 20 is irregular, i.e., that its thickness is uneven; if no device for checking the stream of tobacco were disposed before cam 11, this cam would be acting on a thin layer one time and on a thicker layer another time, which would lead to irregularities in the segments of outgoing cigarette rod 21 compacted by cam 11. In order to avoid this, a stream-checking device 3 is made up of a motor 30—which may be electric, pneumatic, or hydraulic—running at a constant speed and connected by a coupling 31 to a cylindrical disk 32 rotating in a plane disposed perpendicular to the irregularities of layer 20 about an axis of rotation disposed perpendicular to the direction of travel of layer 20.

As may be seen in FIG. 2, the flat, circular top face 32*a* of disk 32 is situated in a plane just beneath the bottom faces 14*a* and 15*a* of side rails 14 and 15; while as may be seen in FIG. 3, the axis of rotation of disk 32 is offset relative to the line of travel of layer 20 so that this layer is intercepted by part of the cylindrical outside surface 32*b* of disk 32 situated near the location where surface 32*b* moves parallel to and in the same direction as layer 20.

Thus, when disk 32 rotates in the direction indicated by an arrow in FIG. 3, the part of surface 32*b* intercepting layer 20 deflects a portion 22 of layer 20 situated below circular top surface 32*a*. When the speed of rotation of disk 32 is such that the peripheral speed of surface 32*b* is close to the speed of travel of layer 20, surplus tobacco fibers 22 are delicately separated from layer 20 without being ripped or torn; this surplus tobacco is eliminated at the side of disk 32 and drops onto a conveyor device, which may be a conveyor device having belts 16*a* and 16*b*, where it is mixed with the surplus tobacco eliminated by trimmer 12 in order to be recycled and returned to intermediate supply 13. Thus, after layer 20 has passed above disk 32, this layer has a consistent thickness determined by the distance separating band 10 from circular top surface 32*a*. In order for layer 20 to be truly uniform, the minimum thickness of layer 20 before passing above disk 32 must always be greater than the regulated thickness. Thus, when cam 11 acts to compress a segment of layer 20, it is always acting upon an identical thickness of that layer, so that the density of the tobacco in the various compressed segments of the final cigarette rod 21 is made uniform.

In a preferred embodiment, clutch coupling 31 is situated between motor 30 and disk 32; for when the machine is started up, disk 32 must be caused to rotate at a speed such that its peripheral linear speed is approximately the same as the speed of travel of layer 20. Thereafter, the friction of the bottom of layer 20 against top surface 32*a* is sufficient to drive disk 32 at the proper speed; it is therefore possible to uncouple the drive of disk 32 by means of clutch 31 and to stop the feed to motor 30. It is quite possible, of course, to provide an embodiment of the inventive device without such disengagement, disk 32 remaining continuously driven by motor 30. The speed of travel of the layer of tobacco in a machine of the type described is on the order of 500–1,000 m/min.

In order to have a consistent separation of surplus 22 from layer 20 of tobacco, various precautions are to be taken as concerns the geometry of disk 32, as well as the material of which it is made. In particular, outside cylindrical surface 32*b* of disk 32 must be disposed perpendicular to the direction of travel of layer 20 in order to eliminate surplus 22 correctly at the side; any faulty alignment of surface 32*b*, in one direction or the other, would bring about a slight compression or expansion of the layer's regulated thickness, which would impair its uniformity. The material of which disk 32 is made must likewise be such that the tobacco particles do not adhere to the disk. For that purpose, in a preferred embodiment, the disk is made of the synthetic material sold by Leder & Co. AG, 8645 Jona, Switzerland, under the registered trademark POLYDUR. However, it is quite possible to use any other material to which the tobacco fibers and dust cannot adhere; more generally, the disk may be made of any material covered with a layer or coating to which tobacco does not adhere. The surface condition of faces 32*a* and 32*b* of disk 32 must be absolutely smooth.

The inventive device for checking a stream of tobacco has been described as mounted just before trimming and compression apparatus in which the stream of tobacco is drawn by suction against a band which moves it; other trimming and compression systems exist to which the inventive device may equally well be applied. More generally, whatever the geometry according to which the cigarette rod is formed, the inventive device may be applied for regulating the thickness of that rod. Likewise, the device may be applied to any apparatus for trimming and reinforcing the cigarette rod which requires thickness regulation of the layer prior to reinforcement and trimming, whatever the manner in which reinforcement of the cigarette tips is carried out.

Hence the device for checking a stream of tobacco according to the present invention is particularly suitable for regulating the thickness of a layer of tobacco having an irregular thickness before this layer enters the reinforcement or compression apparatus, so that the segments of the cigarette rod having greater density all have the same density. By reason of its design and its geometry, the inventive device eliminates the surplus tobacco without damaging it. The introduction of such a device into a machine for making a tobacco rod for cigarettes or other articles of the tobacco industry permits more consistent production, as well as an increase in the quality of the finished products by reducing waste.

What is claimed is:

1. In apparatus for producing a tobacco rod, said apparatus comprising a porous band moving longitudinally and having a lower face, an irregular stream of tobacco being agglomerated by suction against the lower face of the band, a compression device for periodic compression of the stream of tobacco, a trimming device having circular rotating cutters for eliminating surplus tobacco, and a checking device for checking said stream of tobacco having a rotary disk disposed upstream of said compression device, the plane of rotation of said rotary disk being disposed beneath the stream of tobacco perpendicular to the irregularities of the stream of tobacco, the axis of rotation of said rotary disk being disposed perpendicular to the direction of advance of the stream of tobacco, the improvement comprising:

said rotary disk of said checking device having a substantially cylindrical form including a circular top surface in said plane of rotation and a substantially cylindrical outside surface substantially perpendicular to said top surface; wherein:

said disk is disposed so as to intercept, adjacent a portion of said outside surface of said disk, a portion of the stream of tobacco below said plane of rotation;

the axial position of said top surface is fixed for determining the quantity of tobacco of the checked stream; and said portion of said outside surface moves parallel to and in the same direction as said stream of tobacco for carrying along surplus tobacco; said improvement further comprising:

a motor for driving said disk rotatingly upon starting-up thereof and clutch means for uncoupling said motor from said disk when said cylindrical outside surface reaches a linear speed substantially equal to the speed of travel of the stream of tobacco, said disk then being driven by the friction of the stream of tobacco against said top surface of said disk.

2. The apparatus of claim 1, wherein said cylindrical disk is of a tobacco-repellent material.

3. The apparatus of claim 1, wherein said cylindrical disk is of any material, said cylindrical outside surface and said circular top surface being covered by a tobacco-repellent coating or layer.

4. The apparatus of claim 3 wherein said cylindrical outside surface and said circular top surface are aligned relative to said stream of tobacco so as not to damage tobacco fibers in said stream of tobacco.

5. The apparatus of claim 2 wherein said cylindrical outside surface and said circular top surface are aligned relative to said stream of tobacco so as not to damage tobacco fibers in said stream of tobacco.

* * * * *